United States Patent [19]

Fischer et al.

[11] Patent Number: 4,569,155

[45] Date of Patent: Feb. 11, 1986

[54] GRINDING MACHINE AND METHOD FOR FLAT, BOARD-SHAPED WORKPIECES

[75] Inventors: Kurt Fischer, Bad Münder; Helmut Weiner, Springe, both of Fed. Rep. of Germany

[73] Assignee: Bison-Werke Bahre & Greten GmbH & Co. KG, Fed. Rep. of Germany

[21] Appl. No.: 603,743

[22] Filed: Apr. 25, 1984

Related U.S. Application Data

[63] Continuation of Ser. No. 316,535, Oct. 29, 1981, abandoned.

[30] Foreign Application Priority Data

Nov. 3, 1980 [DE] Fed. Rep. of Germany ..... 3041377

[51] Int. Cl.[4] ..... B24B 21/08; B24B 21/14

[52] U.S. Cl. ..... 51/138; 100/160; 51/139

[58] Field of Search ..... 51/137–139, 51/76 R; 144/246 R, 246 A, 246 C, 242 C; 198/624; 100/160, 172, 176, 155 R; 226/181; 271/272–274

[56] References Cited

U.S. PATENT DOCUMENTS

| | | | |
|---|---|---|---|
| 1,953,190 | 4/1935 | Paterson | 100/160 |
| 2,162,279 | 6/1939 | Herchenrider | 51/139 |
| 2,479,506 | 8/1949 | Payton | 51/138 |
| 2,718,827 | 9/1955 | Whittum | 100/160 |
| 3,014,324 | 12/1961 | McCarty | 100/176 |
| 3,111,894 | 11/1963 | Murray | 100/172 X |
| 3,394,501 | 7/1968 | Carlson et al. | 51/138 |
| 3,611,647 | 10/1971 | Davis | 51/139 X |
| 4,178,721 | 12/1979 | Evans | 51/139 |

FOREIGN PATENT DOCUMENTS

| | | | |
|---|---|---|---|
| 701862 | 1/1941 | Fed. Rep. of Germany | 100/160 |
| 2165313 | 7/1973 | Fed. Rep. of Germany . | |

*Primary Examiner*—Frederick R. Schmidt
*Assistant Examiner*—Debra S. Meislin
*Attorney, Agent, or Firm*—Antonelli, Terry & Wands

[57] ABSTRACT

A grinding machine and method for flat, board-shaped workpieces, especially for particle-board materials, fiber materials, veneer materials, and mineral materials, utilizing at least one continuous belt unit having a grinding belt that is supported upon rollers, a counterpressure element, and means for adjustable spacing the counterpressure element relative to the grinding belt for forming a gap corresponding to the thickness of the workpieces being ground therebetween is improved through the further utilization of support means for maintaining the counterpressure element in a substantially plane-parallel orientation relevant to the grinding belt during grinding. In accordance with a preferred embodiment of the grinding machine, the counterpressure element is a backing roller to which a variable pressure is applied by a pneumatic piston-cylinder unit. In accordance with the method aspect of the invention, the grinding is performed prior to full setting of the bonding agent, whereby the maintaining of the substantially plane-parallel orientation of the grinding belt and counterpressure element is of particular significance.

19 Claims, 8 Drawing Figures

GRINDING MACHINE AND METHOD FOR FLAT, BOARD-SHAPED WORKPIECES

This is a continuation of application Ser. No. 316,535, filed Oct. 29, 1981, and now abandoned.

BACKGROUND AND SUMMARY OF THE INVENTION

This invention concerns a grinding machine of the type used during the manufacture of flat, board-shaped workpieces, especially for boards made from particle-board materials, fiber materials, veneer materials, and mineral materials, for example materials containing calcium silicate or other similar boards, with at least one continuous belt unit, consisting of a grinding belt that can be moved or guided over rollers by means of at least one contact element, against the surfaces being ground, and of one counterpressure unit, according to which the workgap between the contact element and the counter-pressure element is adjustable in relation to the thickness of the board being ground.

Grinding machines known in the prior art, which display at least a continuous belt unit of the kind just described, make it possible to grind a surface at a certain treatment depth, or to deposit a surface detail in such a manner that, depending on the case, the upper and lower side of the board may be treated in the same or different ways. This is often important when, because of one or another reasons determined by the board manufacturing process, different technical conditions exist on one or both board surfaces; it may be necessary, according to the exigencies for further processing, to be able to provide the boards with a surface detail or refinement by printing, painting, or sheathing in paper, leaf, veneer, or similar material (cf. *Holztechnik,* October 1973, p. 378–379, 388; cf. *Holz als Roh-und Werkstoff,* 38, 1980, p. 321; *Broschüre der Carborundum-Werke GmbH,* Plant 2, Publication No. 72/3-8000, p. 80–88). According to the grinding process, boards are produced, in general, whose thicknesses lie preferably within prescribed tolerances. Typical allowable tolerances are ±0.3 mm, corresponding DIN 68 761, and in some countries, ±0.15 mm from the nominal thickness (Deppe, H. J.; Ernst, K., *Technologie der Spanplatten,* Stuttgart, 1964, pp. 191–192). In contrast, high-power continuous-belt grinding machines guarantee a thickness tolerance of a maximum of ±0.1 mm, related to the nominal thickness, as well as relatively high forward feeding speeds of around 30 to 40 m/min. They also provide for variable thickness differentials from board to board. In addition, this process assumes a fault-free grinding pattern in order to insure that the boards conform to the demands of further processing. (DE-PS 1977 135, DE-PS 2502 718, Assignee's Prospectus, 12.79).

If, for example, ground boards are to be stacked in a normal manner in great numbers one on top of the other before they are further treated and processed, the problem arises that the boards, especially the ones towards the top of the stack, are increasingly deformed. The degree of this deformation depends essentially not only on the height of the stack, the number of boards in it, the thickness and hardness of the boards, but rather also more especially on the overall accumulative sum of the tolerance values, or the tolerance errors, which can deviate either positively or negatively in each board from the optimum value; it also depends on the thickness of the boards, because heavier, more tightly compressed boards will be deformed to a greater extent than light boards.

By way of example, this means that, in a stack 4 meters high, which is often met in practice, 400 pieces of ground particle boards, 10 mm thick, relatively heavy and tightly packed will be present. In the upper part of the stack of the stacked boards, there may be a bending across their widths (bowing) of at least up to 40 mm when the total deviation per board is 0.2 mm (10.1 mm maximum in the middle of the board, 9.9 mm minimum at the boundary region of the board). In order to make the example more comprehensible, the tolerance errors in the boards, which may be sampled from a day's production before and after grinding, have not been taken into consideration here. If the case concerns particle board, as it does here, then the bonding agent in them hardens while they are stacked and continues to harden after they are unstacked; this means that the variations in the shape over the boards' widths, due to the setting of the boards' internal consistency, is irreversible. Boards of this kind, which, under certain circumstances, are grouped together according to their formats, can no longer be processed in furniture manufacture for this reason.

In connection with the problems outlined in the foregoing, the flawless glueing together of a large number of thin boards, with or without an accompanying sheathing material, in a stack press is precluded. It is in this respect that the accumulated tolerances of the boards cause misbonding patches.

It is the purpose of the invention to create a grinding machine of the type defined at the outset which is adaptable in such a way to the changing loading conditions during the grinding operation resulting from the variable properties (characteristics) of the boards being ground so that boards true to size, and with uniform surface qualities, may be obtained.

This purpose is realized in such a way by the invention that the counterpressure element on the side opposite the work gap is fitted with a support device at least at the midpont along its length that can be fed with a variable pressure.

The basic advantage of this invention's solution, in substantial contrast to prior and present state-of-the-art, consists in the fact that the work gap between the contact element and the counterpressure element, across its entire width, and under the just-named variable loading conditions, is maintained in a plane-parallel position (i.e., they lie parallel to each other in parallel planes); at a certain point on the counterpressure element, a supplementary and variable pressure can be brought to bear. Because this pressure can be used with structural components and subassemblies of the continuous belt unit already in existence, their compact and space-saving design principles may be retained.

By creating a specific condition of plane-parallelism in the work gap, the invention assures that, during the production of boards with variable properties (characteristics), which differ sharply from one another, they may be ground free of faults, both with respect to the quality of their surfaces, as well as with respect to precision in maintaining uniformity in their sizes. A thickness tolerance of upwards of ±0.05 mm, with respect to the nominal thickness, may be assured with confidence and without thickness tolerance errors. The uniformly ground boards are, in this way, even in shape and, when they are stacked one on top of another in piles, they will not be subject to variations in shape. In this way, the disadvantages that have been inherent up to the present, for instance, in stack presses, can be circumvented.

According to this invention, the supporting mechanism may be realized in various ways. Thus, a counterpressure roller, consisting of a steel cylinder with smooth lateral surface areas, may be supported by a backing roller on the side opposite the work gap along its midpoint; both its outer bearings lie over a fork bracket which is driven by a hydraulically or pneumatically impelled piston. This piston can be precisely installed to work in a discontinuous or continuous mode and in relation to the plane-parallel arrangement of the work gap between the contact element and the counterpressure roller, using conventional or modern control techniques.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
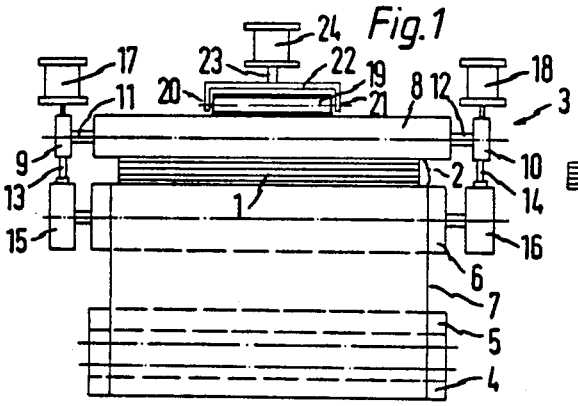
FIG. 1 is a schematic which represents the nature of a continuous belt unit according to a first embodiment of the invention.

FIG. 1 shows a board 1 in a work gap 2 with a continuous belt unit denoted generally by 3 according to an initial invention embodiment. The lower part of the continuous belt unit consists of an endless grinding belt 7 driven over three parallel rollers 4 to 6 (FIG. 2), arranged in a triangular array. Roller 4 serves as the power roller, roller 5 as a tension roller, and roller 6 as a contact roller; it is by means of these that the grinding belt is driven against the underside surface of the board being ground. The contact roller 6 is mounted across from a counterpressure roller 8, which, in this preferred embodiment of the invention, may be mounted by way of a special parallel offset adjustment. The essence of this parallel offset adjustment consists in the fact that bearing-mounted axle journals 11 and 12 of the counterpressure roller 8, which may be mounted on stays or connected to levers or other similar devices 9 and 10, are supported on both ends by adjusting screws 13 and 14 through the bearing housings 15 and 16 of the contact roller 6, which is on the opposite side, and the counterpressure roller 8 is acted upon during the grinding process by two accumulators, such as the pneumatic cylinders 17 and 18. In this way, a flexible, nonpositive connection is produced directly between the contact roller 6 and the counterpressure roller 8, that is, independent of the machine housing (frame); the parallel adjustment of the work gap 2, by means of the adjustment screws 13 and 14, is correctable and play in the equipment produced by the operation, as well as natural wear in the mechanism of the offset adjustment system, can be eliminated by the pneumatic pressure acting on the counterpressure roller 8. In this way, in contrast to other prior art continuous belt units, a distinctive, uniform and high grinding precision can be achieved.

According to the invention, then, the counterpressure roller 8 is supported at the center of its side opposite the work gap 2 by means of the backing roller 19, which, in positions 20 and 21, is supported by a fork bracket 22. The free end of a piston rod 23 works on this fork bracket and, therefore, on the backing roller 19; the force pressure on the piston rod is derived from an accumulator, for example, the pneumatic cylinder 24, and it is so directed that the line of contact between the counterpressure roller 8 and the board 1 is always straight; and the work gap 2, between the counterpressure roller 8 and the contact roller 6, is parallel. According to the expected or actual ascertained load conditions in the work gap, a plane-parallel condition may be obtained by an appropriate variation in the amount of air pressure in the feed to the cylinder 24. Variations in air pressure can be most simply effected by means of a hand-operated pressure regulator (now shown in the drawings). The load conditions in the work gap can be determined from the electric power for the power roller 4 motor; this can be read on instruments or meters, and it provides a means of measuring the load conditions. The amount of air pressure in the cylinder 24 can, of course, be discontinuously or continuously varied and controlled by switching on interconnected scanning, measuring and control equipment for the purpose of fine tuning the counterpressure on the plane-parallel mechanism in the work gap.

Figure 2:
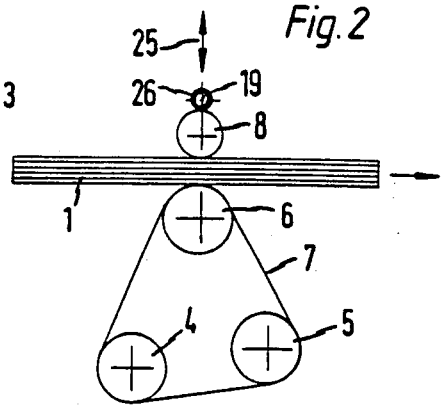
FIG. 2 is a schematic side view of the embodiment of FIG. 1.

As is shown in FIGS. 1 and 2, the backing roller 19, which is controllable in the direction of the double-arrow 25, is provided with a covering 26 made from rubber, plastic, or a similar material. Such a covering serves both to reduce wear on the circumferential surfaces of the counterpressure roller 8, as well as to improve the pressure force compensation. According to another preferred embodiment of the invention, the counterpressure roller 8 is constructed in an elastically-deformable manner. By virtue of this feature, it is possible to obtain an especially advantageous, precise compensation which, in the continuous work mode, assures that each ground board will be without faults.

Although it is basically sufficient to support the counterpressure element at its side opposite the work gap only at the midpoint along its length and to supply it with variable pressure, it is contemplated, in accordance with the present invention, if it were necessary, to provide multiple support devices along the entire length of the counterpressure element; these would be independent of one another and could be fed with variable pressures. This is to be especially recommended with continuous belt units designed for relatively large working widths, and/or which do not have the adjustment means 13 and 14, and/or which operate with counterpressure rollers having, according to the design, diameters substantially smaller than the contact rollers. In this way, very specific conditions, which are optimally adjustable according to the most varied grinding conditions, are guaranteed in the work gap.

Figure 3:
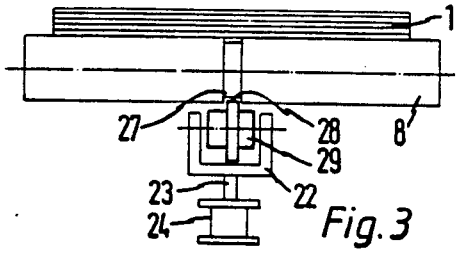
FIG. 3 is a second embodiment according to the invention in a schematic front view.

The schematic front view according to FIG. 3 shows a counterpressure roller 8 which, in the midregion along its length, has a ring-shaped groove 27, into which a ring-shaped projection 28 of a backing roller 29 is fitted. The ring-shaped groove 27 has been so designed in width that the board 1 does not sag at this point. If only the projection 28 of the backing roller 29 works together with the groove 27 of the counterpressure roller 8, then, at the same time, wear will be eliminated for the operational lateral surface areas of the counterpressure roller 8, which are in contact with the board 1, and which, for the rest, may possess more ring-shaped projections and grooves.

Figure 4:
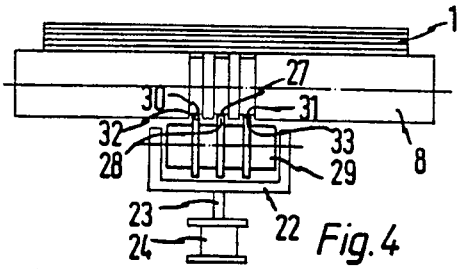
FIG. 4 is a modified version of the continuous belt unit of FIG. 3.

The embodiment according to FIG. 4 expands on the concept of the FIG. 3 embodiment, only here now the number of grooves in the counterpressure roller 8 and the number of projections in the backing roller 29 have been increased by two, that is, 30, 31, 32 and 33, so that now there are more operational work surfaces for the pressure transfer. The counterpressure 8 has been completely provided with ring-shaped projections and grooves in order to more sensitively compensate and even out the pressure transfer and distribution on the board 1. This is an advantage.

Figure 5:
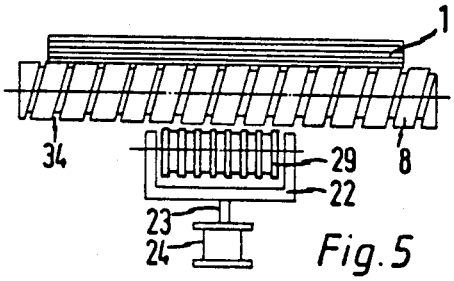
FIG. 5 is another embodiment of the invention shown in a schematic front view.
Figure 6:
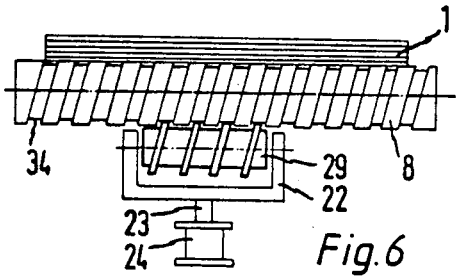
FIG. 6 is a schematic representation of still another embodiment of the continuous belt unit according to the invention.

The projections on the backing rollers 29 in the embodiments according to FIGS. 5 and 6 have had the circumferential and work surfaces of the counterpressure roller 8, so adapted with helical grooves 34, that the projections of the backing rollers 29 are always only in connection with the lateral surfaces of the projections (FIG. 5) or with the recesses (FIG. 6) of the counterpressure rollers. In this way, an optimal condition is achieved whereby brush rollers and/or extraction devices are unnecessary (viz. DE-PS 25 02 718).

It is clear that, with respect to FIGS. 3, 4 and 5, the backing rollers 29 can be advantageously fitted with the other kinds of counterpressure rollers, either preceding them or following them; these may consist, as, for example, in FIG. 1, of a steel cylinder with smooth surfaces.

Figure 7:
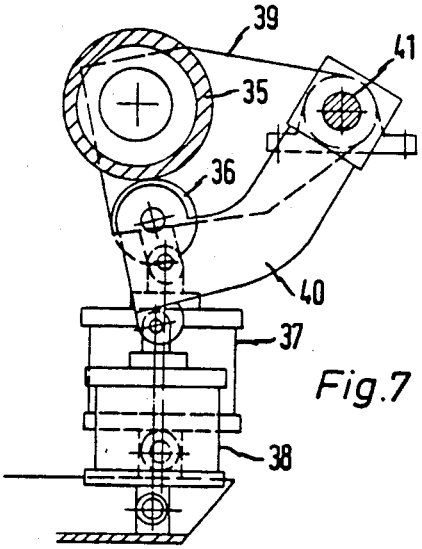
FIG. 7 is a side view of structural components.

FIG. 7 shows a counterpressure roller 35 and a backing roller 36, piston-cylinder units 37 and 38, as well as swing arms 39 and 40 with a common pivot axis 41. Here, the essential features of the invention are presented from the point of view of design in an especially simple and sparing manner. This embodiment represents a detailed example of the schematically-described mounting and adjusting arrangement for rollers 8 and 19, piston-cylinder units 37, 38 corresponding to accumulators 17, 18 and 24.

Figure 8:
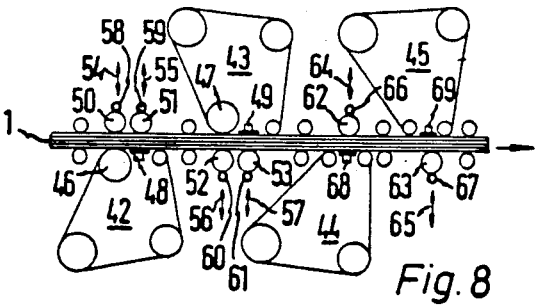
FIG. 8 is a side view of an application of the invention in continuous belt units in a staggered array.

FIG. 8 shows how the invention may be applied in a grinding machine for double-sided grinding of a board 1 by means of four continuous belt units 42, 43, 44 and 45, arranged in a staggered fashion with respect to one another. It is easy to recognize that the continuous belt units 42 and 43 include the contact rollers 46 and 47 and the grinding shoes 48 and 49 in the actual work gap, as well as the counterpressure rollers 50, 51, 52 and 53 opposed to them; the counterpressure rollers 50, 51, 52 and 53 work together in the direction of the double arrows 54, 55, 56 and 57 with a variable pressure feed. The following continuous belt units 44 and 45 are also provided, according to the invention, with the same kinds of counterpressure rollers and backing rollers, and with the pressure-fed backing rollers 66 and 67, and the counterpressure roller indicated by the reference numerals 62 and 63, working together in the directions indicated by the double arrows 64 and 65; the pressure transfer is carried out essentially only on the grinding shoes 68 and 69. It should be appreciated also that board 1 can be conventionally received by the grinding machine directly or indirectly from a board-forming press.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. In a grinding machine of the type for grinding flat, board-shaped workpieces of particle-board materials, fiber materials, veneer materials, mineral materials or the like, and having an endless belt unit with an endless grinding belt supported upon rollers, a counterpressure roller, and means for adjustably spacing the counterpressure roller relative to the grinding belt for forming a gap corresponding to the thickness of the workpieces being ground therebetween, the improvement comprising contact means situated supporting said grinding belt at a position directly opposite said counterpressure roller and being free of any backing means, and support means for maintaining said counterpressure roller in a substantially parallel orientation relative to said grinding belt during grinding, said support means comprising a single backing roller mounted so as to engage a side of said counterpressure roller opposite said gap, in a common plane with said counterpressure roller and said contact means, only at an axially central portion along the length of said counterpressure roller, and a variable pressure applying means connected to said backing roller for controlling the force with which the backing roller engages the counterpressure roller, independent of said means for adjustably spacing said counterpressure roller, wherein the counterpressure roller is carried by a first swing-arm that is displaceable about a pivot axis by a first piston-cylinder unit and wherein said backing roller is carried by a second swing-arm that is displaceable about said pivot axis by a second piston-cylinder unit forming said variable pressure applying means.

2. A grinding machine according to claim 1, wherein said second swing-arm is in the form of a fork bracket.

3. A grinding machine according to claim 2, wherein said backing roller is a smooth steel cylinder.

4. A grinding machine according to claim 2, characterized in that the backing roller is provided with a resilient covering.

5. A grinding machine according to claim 4, wherein said covering is made of rubber.

6. A grinding machine according to claim 4, wherein said covering is made of plastic.

7. A grinding machine according to claim 6, characterized in that said backing roller is provided with a plurality of projections.

8. A grinding machine according to claim 4, wherein said backing roller has a smaller diameter than the counterpressure roller.

9. A grinding machine according to claim 2, characterized in that the backing roller has at least one ring-shaped projection.

10. A grinding machine according to claim 2, characterized in that the backing roller has at least one helical projection.

11. A grinding machine according to claim 1, wherein said contact means is a positionally-adjustable grinding shoe provided within said endless grinding belt for supporting same against the workpiece.

12. A grinding machine according to claim 11, wherein a second counterpressure roller with a second support means is disposed opposite said belt at a point upstream of said grinding shoe.

13. A grinding machine according to claim 1, wherein a plurality of said endless belt units are provided staggered above and below a workpath for enabling double-sided grinding.

14. In a grinding machine of the type for grinding flat, borad-shaped workpieces of particle-board materials, fiber materials, veneer materials, mineral materials or the like, and having an endless belt unit with an endless grinding belt supported upon rollers, a counterpressure roller, and means for adjustably spacing the counterpressure roller relative to the grinding belt for forming a gap corresponding to the thickness of the workpieces being ground therebetween, the improvement comprising contact means situated supporting said grinding belt at a position directly opposite said counterpressure roller and being free of any backing means, and support means for maintaining said counterpressure roller in a substantially parallel orientation relative to said grinding belt during grinding, said support means comprising a single backing roller mounted so as to engage a side of said counterpressure roller opposite said gap, in a common plane with said counterpressure roller and said contact means, only at an axially central portion along the length of said counterpressure roller, and a variable pressure applying means connected to said backing roller for controlling the force with which the backing roller engages the counterpressure roller, independent of said means for adjustably spacing said counterpressure roller, wherein said backing roller is supported by a fork bracket and has at least one ring-shaped projection wherein said variable pressure applying means is a pneumatic piston-cylinder unit having a piston rod drivably connected to said bracket, and wherein said counterpressure roller is provided with groove means for receiving said at least one backing roller ring-shaped projection in a manner limiting contact between said backing roller and counterpressure roller to engagement of said projection within said groove means, whereby wearing of workpiece engaging surfaces of said counterpressure roller are minimized.

15. A grinding machine according to claim 14, characterized in that said backing roller is provided with a plurality of said projections.

16. In a grinding machine of the type for grinding flat, board-shaped workpieces of particle-board materials, fiber materials, veneer materials, mineral materials or the like, and having an endless belt unit with an endless grinding belt supported upon rollers, a counterpressure roller, and means for adjustably spacing the counterpressure roller relative to the grinding belt for forming a gap corresponding to the thickness of the workpieces being ground therebetween, the improvement comprising contact means situated supporting said grinding belt at a position directly opposite said counterpressure roller and being free of any backing means, and support means for maintaining said counterpressure roller in a substantially parallel orientation relative to said grinding belt during grinding, said support means comprising a single backing roller mounted so as to engage a side of said counterpressure roller opposite said gap, in a common plane with said counterpressure roller and said contact means, only at an axially portion along the length of said counterpressure roller, and a variable pressure applying means connected to said backing roller for controlling the force with which the backing roller engages the counterpressure roller, independent of said means for adjustably spacing said counterpressure roller, wherein said backing roller is supported by a fork bracket and has at least one helical projection, wherein said variable pressure applying means is a pneumatic piston-cylinder unit having a piston rod drivably connected to said bracket, and wherein said counterpressure roller is provided with groove means for receiving said at least one backing roller helical projection in a manner limiting contact between said backing roller and counterpressure roller to engagement of said projection within said groove means, whereby wearing of workpiece engaging surfaces of said counterpressure roller are minimized.

17. A grinding machine according to claim 16, characterized in that said backing roller is provided with a plurality of said projections.

18. In a grinding machine of the type for grinding flat, board-shaped workpieces of particle-board materials, fiber materials, veneer materials, mineral materials or the like, and having an endless belt unit with an endless grinding belt supported upon rollers, a counterpressure roller, and means for adjustably spacing the counterpressure roller relative to the grinding belt for forming a gap corresponding to the thickness of the workpieces being ground therebetween, the improvement comprising contact means situated supporting said grinding belt at a position directly opposite said counterpressure roller and being free of any backing means, and support means for maintaining said counterpressure roller in a substantially parallel orientation relative to said grinding belt during grinding, said support means comprising a single backing roller mounted so as to engage a side of said counterpressure roller opposite said gap, in a common plane with said counterpressure roller and said contact means, only at an axially central portion along the length of said counterpressure roller, and a variable pressure applying means connected to said backing roller for controlling the force with which the backing roller engages the counterpressure roller, independent of said means for adjustably spacing said counterpressure roller, wherein said backing roller is supported by a fork bracket and wherein said variable pressure applying means is a pneumatic piston-cylinder unit having a piston rod drivably connected to said bracket, said backing roller being provided with a resilient plastic covering and having a plurality of multiple ring-shaped projections thereon, wherein the counterpressure roller is helically grooved so as to define helical projections thereon and the multiple ring-shaped projections on the backing roller are supported on external circumferential surface of the helical projections of the counterpressure roller.

19. In a grinding machine of the type for grinding flat, board-shaped workpieces of particle-board materials, fiber materials, veneer materials, mineral materials or the like, and having an endless belt unit with an endless grinding belt supported upon rollers, a counterpressure roller, and means for adjustably spacing the counterpressure roller relative to the grinding belt for forming a gap corresponding to the thickness of the workpieces being ground therebetween, the improvement comprising contact means situtated supporting said grinding belt at a position directly opposite said counterpressure roller and being free of any backing means, and support means for maintaining said counterpressure roller in a substantially parallel orientation relative to said grinding belt during grinding, said support means comprising a single backing roller mounted so as to engage a side of said counterpressure roller opposite said gap, in a common plane with said counterpressure roller and said contact means, only at an axially central portion along the length of said counterpressure roller, and a variable pressure applying means connected to said backing roller for controlling the force with which the backing roller engages the counterpressure roller, independent of said means for adjustably spacing said counterpressure roller, wherein said backing roller has at least one ring-shaped projection and is supported by a fork bracket, wherein said variable pressure applying means is a pneumatic piston-cylinder unit having a piston rod drivably connected to said bracket and wherein said counterpressure roller is a smooth cylindrical steel roller provided with a groove within which said backing roller ring-shaped projection is received.

* * * * *